US005413086A

United States Patent [19]

Trudeau

[11] Patent Number: 5,413,086

[45] Date of Patent: May 9, 1995

[54] CONCRETE PILE CUTTER

[76] Inventor: Leon B. Trudeau, 138 Tufnell Drive, Winnipeg, Canada, R2N 1J8

[21] Appl. No.: 934,661

[22] PCT Filed: Jul. 17, 1991

[86] PCT No.: PCT/CA91/00250

§ 371 Date: May 7, 1993

§ 102(e) Date: May 7, 1993

[87] PCT Pub. No.: WO92/01841

PCT Pub. Date: Feb. 6, 1992

[51] Int. Cl.[6] ..... B28D 1/32

[52] U.S. Cl. ..... 125/23.01; 125/12

[58] Field of Search ..... 125/23.01, 12, 16.01; 83/639, 694, 821, 824, 928; 30/289, 294; 144/34 R, 34 E

[56] References Cited

U.S. PATENT DOCUMENTS

| | | | |
|---|---|---|---|
| 2,612,194 | 9/1952 | Ingraham et al. | 144/34 E |
| 2,808,822 | 10/1957 | Celapine | 125/23.01 |
| 2,819,710 | 1/1958 | Mangis | 125/123.01 |
| 3,056,287 | 10/1962 | McKee | 125/23.01 |
| 3,056,567 | 10/1962 | McKee | 125/23.01 |
| 3,392,719 | 7/1968 | Clanton | 125/23.01 |
| 3,491,811 | 1/1970 | Larson et al. | 83/639 |
| 3,495,489 | 2/1970 | Savory | 83/639 |
| 3,727,600 | 4/1973 | Schlough | 125/23.01 |
| 4,114,270 | 9/1978 | Jansen-Herfeld et al. | 83/82 |
| 4,124,015 | 11/1978 | Isaksson | 125/23.01 |
| 4,273,171 | 6/1981 | Spaulding | 83/928 |
| 4,641,694 | 2/1987 | Rohde | 144/34 E |
| 4,979,489 | 12/1990 | Abbasov et al. | 125/23.01 |

FOREIGN PATENT DOCUMENTS

| | | | |
|---|---|---|---|
| 215878 | 11/1960 | Austria | 125/23.01 |
| 133016 | 3/1910 | Canada | 125/23.01 |
| 167684 | 2/1916 | Canada | 125/23.01 |
| 909684 | 2/1972 | Canada | 125/23.01 |
| 1142417 | 3/1983 | Canada | 125/23.01 |
| 1143255 | 3/1983 | Canada | 125/23.01 |
| 1219789 | 3/1987 | Canada | 125/23.01 |
| 0051837 | 5/1982 | European Pat. Off. . | |
| 0243981 | 11/1987 | European Pat. Off. . | |
| 353303 | 2/1990 | European Pat. Off. . | |
| 2219134 | 4/1973 | Germany | 125/23.01 |
| 2505298 | 11/1975 | Germany | 125/23.01 |
| 3122848 | 1/1983 | Germany | 125/23.01 |
| 8400404 | 9/1985 | Netherlands | 125/23.01 |
| 8705064 | 8/1987 | WIPO | 125/23.01 |

OTHER PUBLICATIONS

Civil Engineering and Public Works Review, vol. 59, No. 12, Dec. 1964, London, p. 1511, "Engineering Developments In The USSR".

*Primary Examiner*—Maurina T. Rachuba

*Attorney, Agent, or Firm*—Murray E. Thrift; Adrian D. Battison; Stanley G. Ade

[57] ABSTRACT

A method and apparatus are described for preparing an end of a reinforced concrete pile (68). Excessive lengths of the driven pile are cut off using a shear blade (22) that is driven through the concrete and reinforcing steel (102) of the pile. Concrete is then removed down to a certain level below the cutoff position using a pair of blades (62) that engage the surface of the pile and penetrate the surface while wedging the upper pan of the pile up away from the main body of the pile. This cracks the concrete through at the desired position. At the same time, concrete breakers (88) engage the concrete pile above the blades to fracture the concrete from the reinforcing steel. This eliminates the need for cutting of the piles with explosives and the removal of concrete using pneumatic hammers.

24 Claims, 5 Drawing Sheets

CONCRETE PILE CUTTER

FIELD OF THE INVENTION

The present invention relates to the treatment of reinforced concrete piles after driving.

BACKGROUND

In the use of reinforced concrete piles for supporting buildings, it is common practice to drive the piles and then to cutoff the amount of pile projecting above the desired finished level. This removal of the undesired pile portion involves cutting the pile at a cutoff level and then removing the concrete down to the finished level, exposing length of the reinforcement for incorporation into a subsequently poured concrete structure.

Conventionally, piles are cutoff using explosives. The concrete is removed to the finished level using a jackhammer. This procedure is time consuming and costly. In most cases, it is necessary to obtain a permit for the necessary blasting. In addition, the shock waves caused by the blasting can damage the pile. While mechanical cutters have been proposed for cutting off piles, these have not proven entirely satisfactory because they are difficult to use, especially where access to piles is restricted. They do not address the problem of removing concrete from the reinforcement down to the finished level.

SUMMARY

According to one aspect of the present invention there is provided a method of preparing an end of a pile comprising a concrete matrix and elongate reinforcement therein, said method comprising:

providing a plurality of blades, oriented transversely of the pile at a selected position along the pile;

transversely breaking the concrete matrix at the selected position by driving the blade into the surface of the concrete matrix around the periphery of the pile, without engaging the reinforcement;

providing a concrete breaker means adjacent the pile and extending between the end of the pile and selected position;

fracturing the concrete matrix between the end of the pile and the selected position along the pile by driving the breaker means into engagement with the concrete matrix; and removing the fractured concrete to expose the reinforcement.

According to another aspect of the present invention there is provided apparatus for preparing an end of a pile comprising a concrete matrix and longitudinal reinforcement embedded therein, said apparatus comprising:

a plurality of blades having respective cuffing edges;

means for mounting the blades around the pile and at a selected position along the pile with the cutting edges confronting the pile;

means for driving the cutting edges of the blades into the surface of the concrete matrix around the periphery of the pile;

concrete breaker means;

means for mounting the breaker means adjacent the pile and between the end of the pile and the selected position;

means for driving the breaker means into engagement with the concrete matrix.

In preferred embodiments of the apparatus, the blades are shaped to match the profile of the pile and are wedge shaped in section so that as they are driven into the surface of the pile, tension is applied to the concrete matrix, causing it to fracture generally in the plane of the blades. The breakers are preferably mounted with the blades and operate simultaneously with them so that in a single actuation of the apparatus, the concrete above the finished level is separated from the remainder of the pile and broken into fragments.

It is also preferred that the apparatus be constructed using a frame and drivers that will accommodate a shear blade and an anvil for cutting off the pile.

BRIEF DESCRIPTION OF THE DRAWINGS

In the accompanying drawings, which illustrate exemplary embodiments of the present invention.

DETAILED DESCRIPTION

Figure 1:
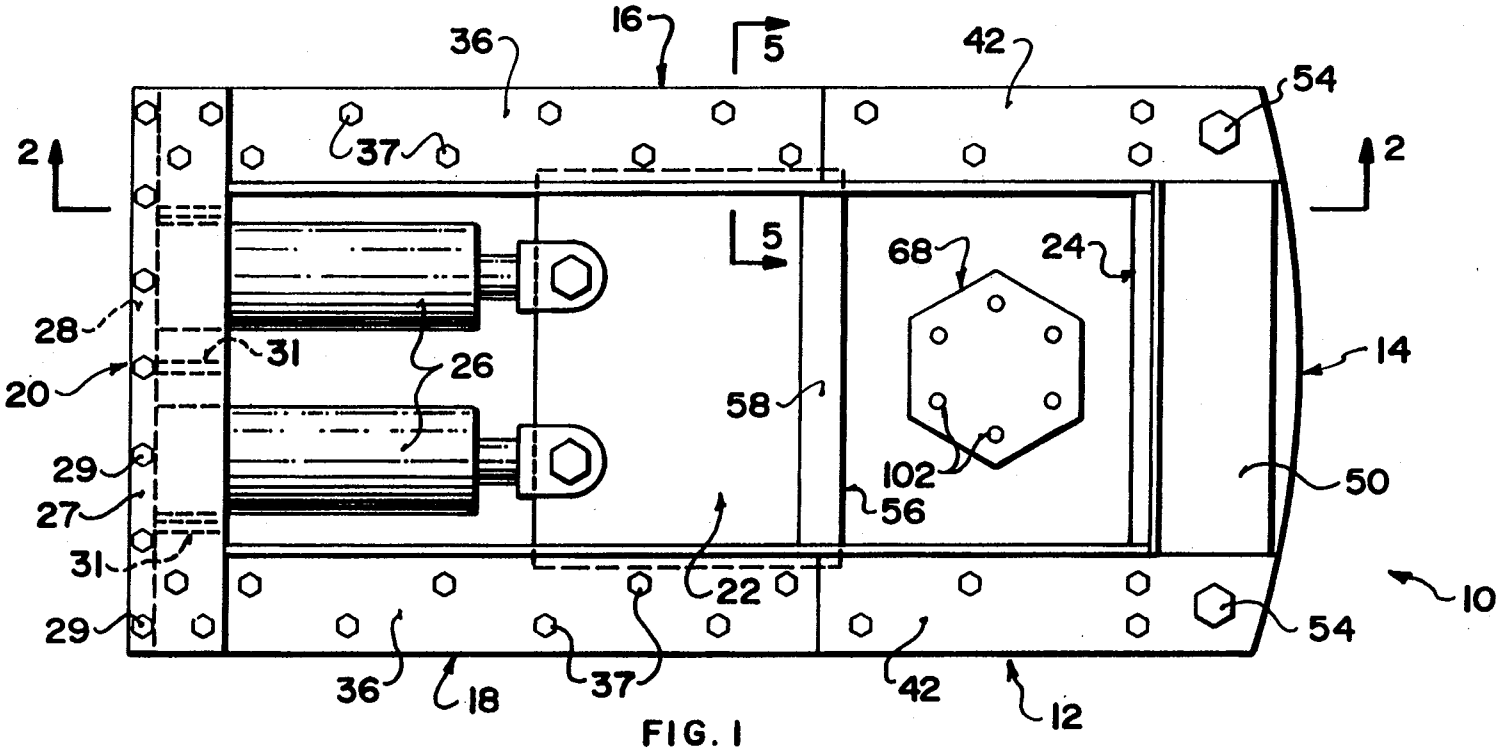
FIG. 1 is a plan view of an apparatus for cutting off a pile end according to the present invention.

Referring to the accompanying drawings, especially FIGS. 1 through 4, there is illustrated a pile cutter 10 having a rectangular frame 12 with a head end 14, two side rails 16 and 18 and a foot end 20. As illustrated in FIGS. 1 through 4 the frame accommodates a sliding shear blade 22 and an anvil 24 on the head end 14, confronting the blade. The shear blade is connected to two hydraulic cylinders 26 that extend between the blade and the foot end 20 of the frame. When the cylinders are extended, they drive the blade forwards, into engagement with the anvil 24.

Figure 2:
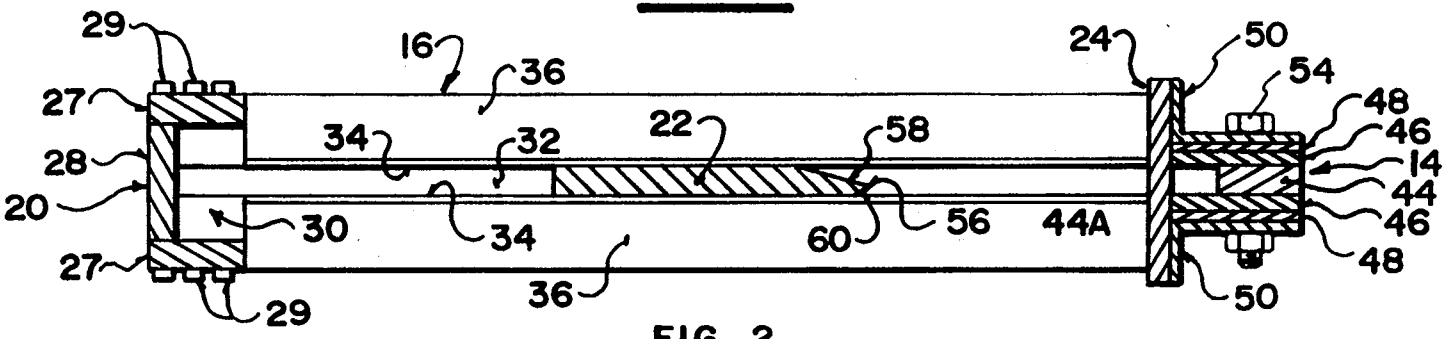
FIG. 2 is a cross-section along line 2—2 of FIG. 1.
Figure 3:
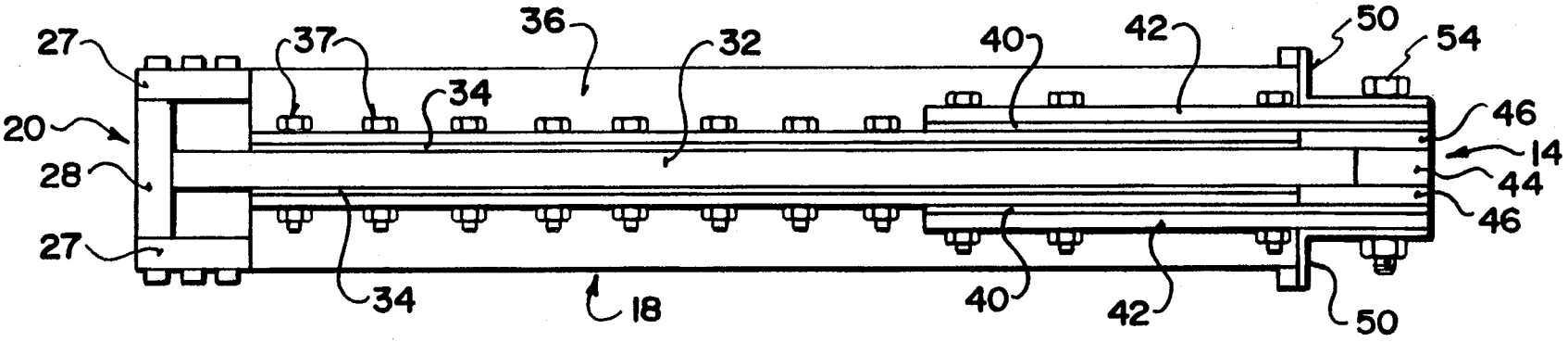
FIG. 3 is a side elevation of the apparatus of FIG. 1.

As illustrated most particularly in FIG. 2, the foot end of the frame 12 is composed of two plates 27 that are on opposite sides of an end plate 28 and fastened in place by a series of bolts 29. The plates 27 and 28 form a channel 30 opening forwardly into the centre of the rectangular frame for receiving the ends of the hydraulic cylinders as illustrated in FIG. 1. Vertical plates 31 form pockets in the channel for seating the cylinder ends.

Figure 5:
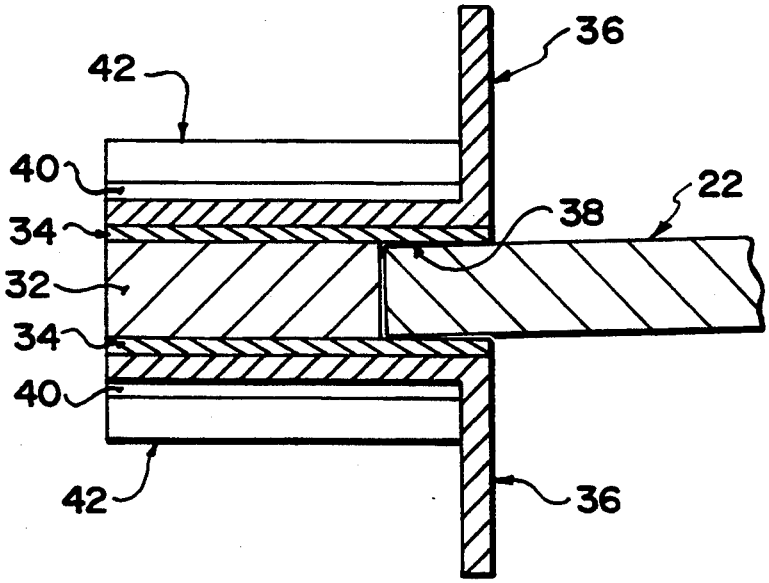
FIG. 5 is a cross-section along line 5—5 of FIG. 1.

Each of the side rails 16 and 18 has a centre plate 32 extending from end to end. On either side of the centre plate 32 is a wear plate 34. The wear plates are wider than the centre plate as illustrated most particularly in FIG. 5. Each wear plate is covered with an angle 36 that extends between the head 14 and foot 20 of the frame. The angles and plates of each side rail are connected using bolts 37. Between the wear plates, the side rail has a channel 38 that accomodates the edge of the shear blade 22 and guides it as it slides in the frame towards the anvil.

Near the head end of the frame, the side rails are reinforced with plates 40 and 42 fastened in place on top of the horizontal flanges of the angles 36. The plates 40 and 42 project beyond the end of the angles 36 to the head end of the frame. The head end, as illustrated in FIG. 2 has a centre plate 44 between two wider plates 46, in turn sandwiched between two thinner plates 48. An angle 50 is superimposed on each plate 48 to complete the head of the frame.

Figure 4:
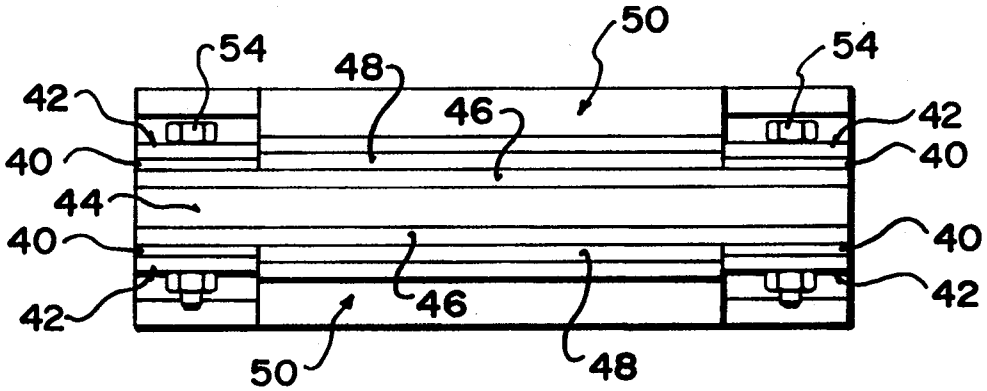
FIG. 4 is an end elevation of the apparatus of FIG. 1.

As illustrated most particularly in FIG. 4, the centre plate 44 and plates 46 extend beyond the end of the plate 48 and angles 50, between the extended ends of the plates 40 and 42. The head is connected to the side rails by bolts 54. The anvil 24 is mounted on the face of the vertical flanges of angles 50.

The configuration of the shear blade is most clearly illustrated in FIG. 2. The cutting edge 56 of the blade is an assymmetric bevel, a long bevel 58 extending from the top face of the blade the edge and a shorter bevel 60 along the bottom. The bevelling along the cutting edge is assymmetrical as shown so that the blade not will have a tendency to be cammed up as it is being driven through the concrete pile. The blade serves to sever the concrete matrix as well as the steel reinforcement cables of the pile.

Figure 6:
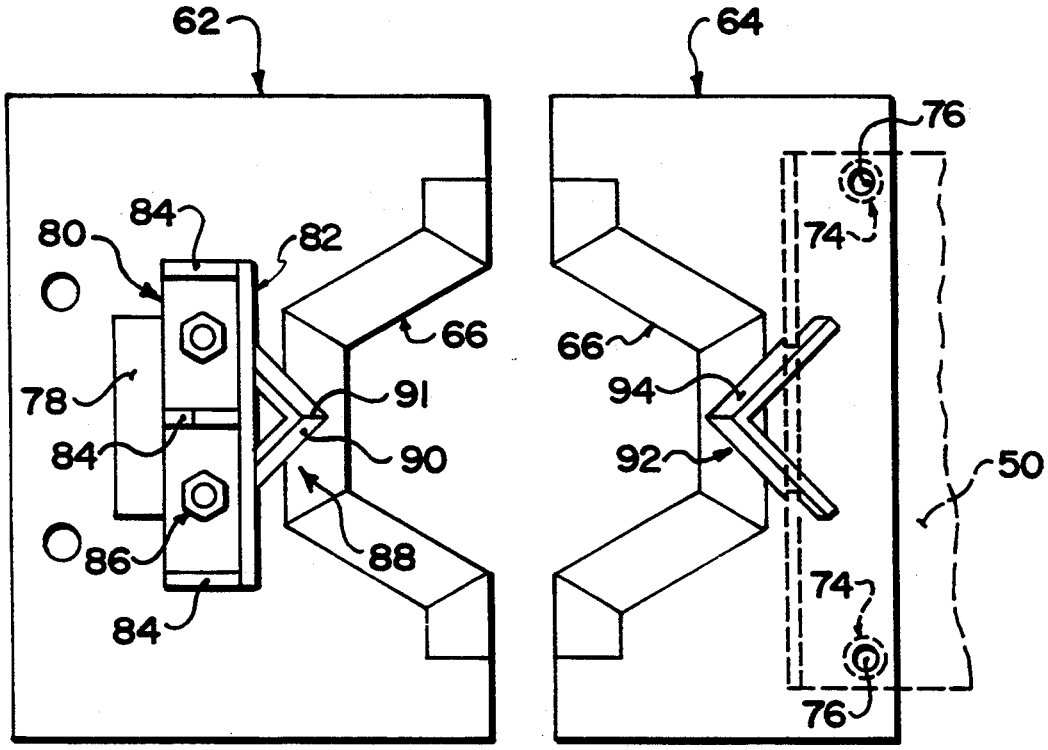
FIG. 6 is a plan view of a set of blades and breakers for cutting and breaking the concrete pile.
Figure 7:
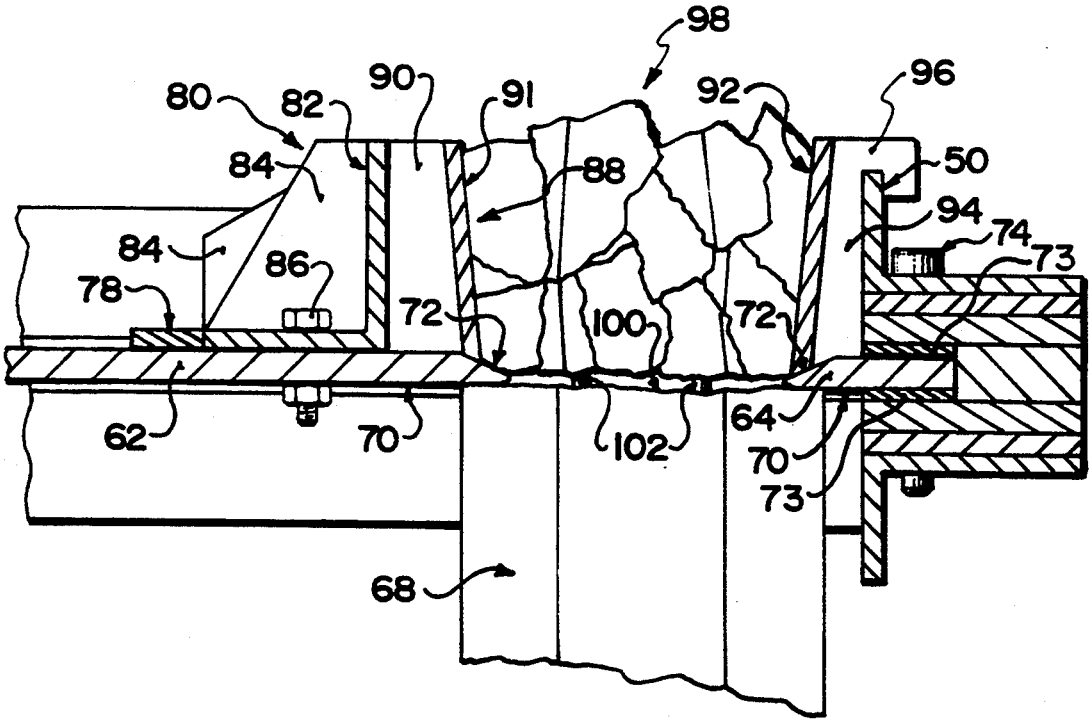
FIG. 7 is a cross-sectional elevation showing the use of the apparatus using the blades illustrated in FIG. 6.

Once the top of the pile has been cut off, the blade 22 and anvil 24 may be removed from the frame and replaced with a second set of tooling for removing the concrete matrix from the reinforcement above a selected level. A set of blades for this purpose is illustrated in FIGS. 6 and 7. It includes a blade 62 that replaces the shear blade 22 and a blade 64 that replaces the anvil 24. Each blade has a cutting edge 66 that matches the profile of one-half of the pile 68 (FIG. 1 ). The illustrated pile is hexagonal and each of the blades has a half hexagonal edge.

As illustrated most particularly in FIG. 7, each of the blades has a flat bottom surface 70 and a bevel 72 along the top surface, adjacent the cutting edge. The blade 62 slides in the channels 38 of the side rails like the shear blade 22. The blade 64 is set into the channel in the head of the frame that is exposed when the anvil is removed. This is most clearly shown in FIG. 7. Two additional shim plates 73 are inserted between the blade and the plates 46. Two pins 74 extend through holes 76 in the blade and through mating holes in the frame head to keep the blade 64 in place. These pins do not take a great deal of stress and serve primarily to keep the blade attached to the head when the blades are withdrawn from the pile.

Blade 62 has a rectangular stop 78 mounted on its top surface. This engages the back edge of a bracket 80 fastened to the top of the blade. The bracket includes an angle 82 with a horizontal flange on top of the blade and a vertical flange projecting upwardly from the top of the blade. The vertical flange is supported by gussets 84. The bracket is fastened to the blade by two bolts 86.

A concrete breaker 88 is mounted on the bracket 80. This is an upright section of angle 90 fastened to the front face of the bracket. The leading edge 91 of the breaker slopes rearwardly away from the cutting edge, with the bottom of the leading edge, located slightly behind the cutting edge of the blade of blade 62, with the bottom of the leading edge located slight behind the cutting edge of the blade. A second breaker 92 is mounted on the head of the frame above blade 64. The second breaker is a section of angle 94 formed with a hook 96 at the top, rear of the flanges for engagement over the vertical flange of the upper angle 50 as illustrated in full in FIG. 7 and ghost line in FIG. 6.

The blades 60 and 62 and the associated breakers are used as illustrated in FIG. 7. The blades are located below the position 98 where the pile has been severed by the severing blade 22. The blades 63 and 64 are driven into the surface of the pile at a finished level 100. As the blades penetrate the surface of the concrete matrix, the wedging action produced by the bevel 72 on each blade applies tension on the concrete matrix of the pile, splitting the concrete at the plane of the blades. The blades do not penetrate far enough into the concrete to engage the reinforcement strands 102. The two breakers are also driven against opposite sides of the concrete and produce high local stresses that will fracture the concrete matrix off of the reinforcement. The cutter may then be lifted as a unit to pull the broken concrete off the reinforcement. This progress may be repeated to expose as much reinforcement as is required.

Figure 8:
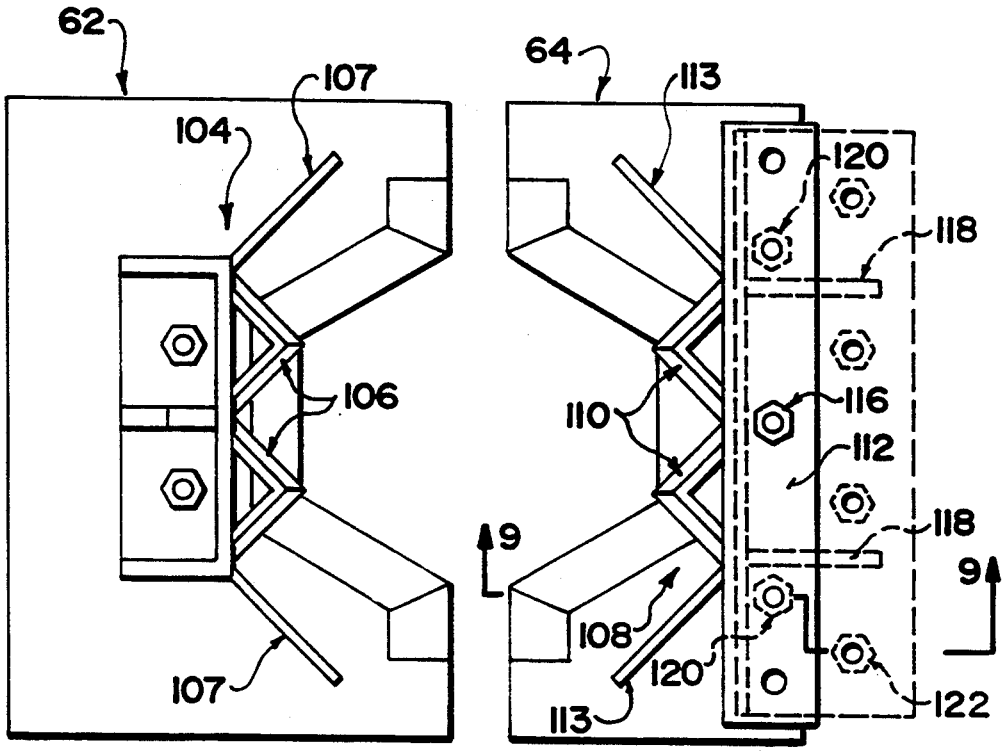
FIG. 8 is a plan view of a second embodiment of the blades and breakers.
Figure 9:
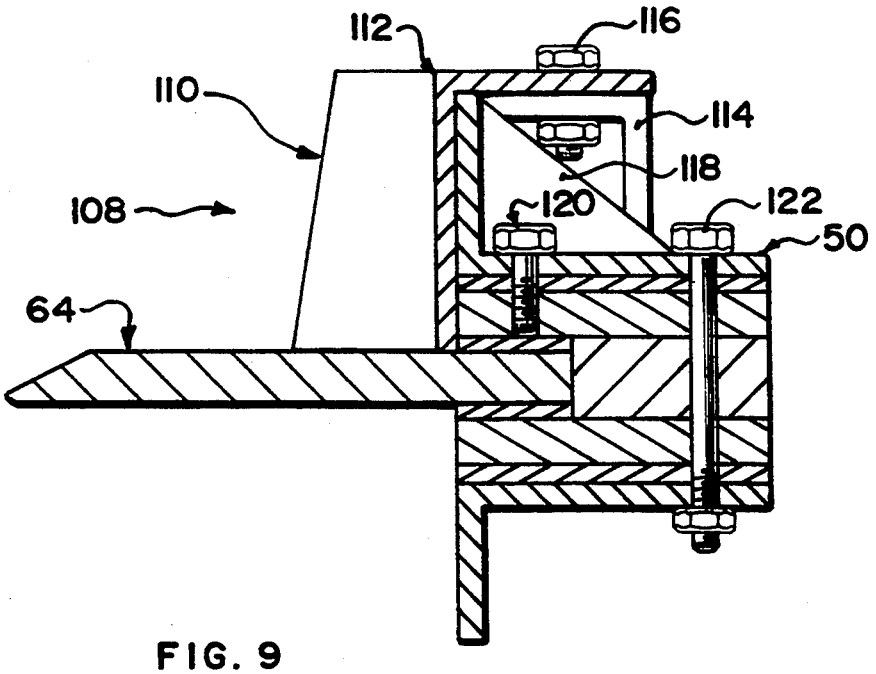
FIG. 9 is a cross section along line 9—9 of FIG. 8.

A second embodiment of the breaker is illustrated in FIG. 8 and 9. In this embodiment, a breaker 104 is mounted on the blades 62. It is similar to the breaker 88 but has two side by side angles 106 on the face of the bracket. Two concrete retaining plates 107 that extend outwardly from the other sides of the angles. These act to retain loose concrete and assist in lifting it off the reinforcement.

Blade 64 in this embodiment carries a breaker 108 consisting of two upright angles 110 mounted on the front of a vertical flange of a mounting angle 112. Two retaining plates 113 extend outwardly from the outer sides of the angles 110. The angle 112 also has a horizontal flange at the top that extends over the top of the head angle 50 and is secured to a bracket 114 by a bolt 116. The bracket is mounted on the back of the angle 50, which is reinforced with a series of gussets 118. In this embodiment, bolts 120 extend through the angle 50, through the plates 48 and into plates 46 above and below the blade 64. Additional bolts 122 extend through the angles, the plates and the centre plate of the frame head.

The double breaker is used for breaking piles of a larger size than those accommodated by the single angle breaker of the previous embodiment.

Figure 10:
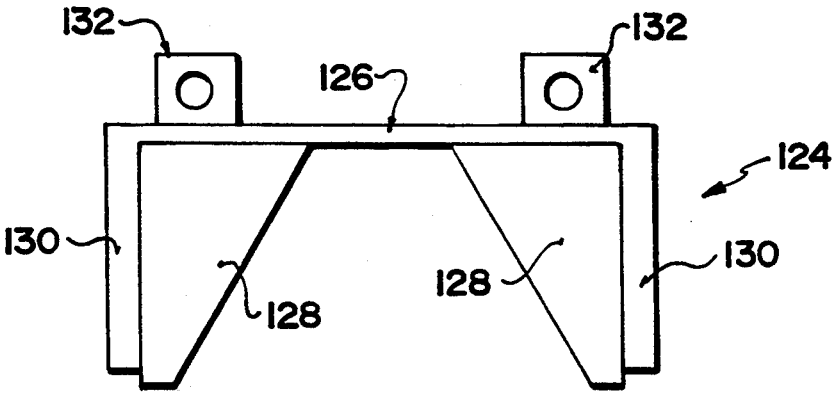
FIG. 10 is a plan view of a centering anvil for use with the shear blade of FIG. 1.
Figure 11:
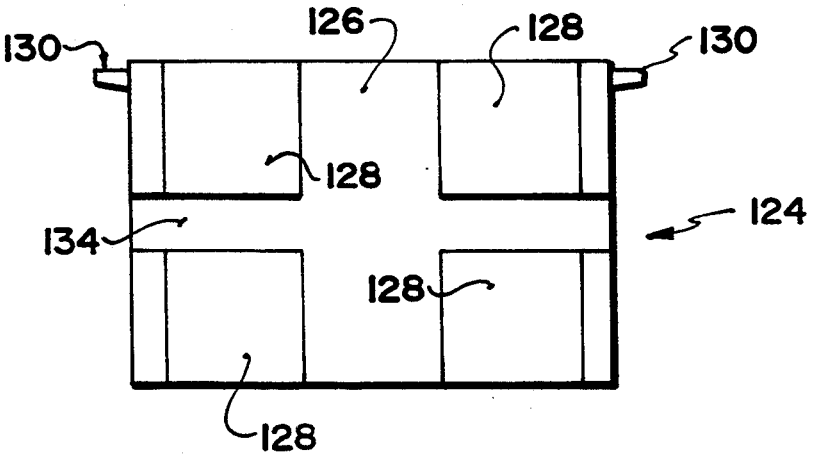
FIG. 11 is a front elevation of an anvil of FIG. 10.

FIGS. 10 and 11 illustrate a centering guide and anvil 124 for use with the shearing blade of FIGS. 1 and 2. The unit includes a base plate 126 that mounts on the head of the frame in place of the anvil 24. The base plate has a series of four bolsters 128 on its front face. The bolsters have angled front faces that match the configuration of the pile so as to engage around a side of the pile and centre the frame properly on the pile for cuffing purposes. Two flanges 130 project from opposite sides of the bolsters at the top to rest on the side rails of the frame. Two lugs 132 project from the back face of the base plate 126 to be bolted to the frame head. The bolsters are arranged in vertically spaced pairs leaving a slot 134 across the middle of the unit to accommodate the shear blade 22.

While particular embodiments of the invention have been described in the foregoing, it is to be understood that other embodiments are possible within the scope of the invention. Thus, for example, particular reference has been made to an hexagonal pile. Other pile shapes are known however, and may be processed according to the invention using blades that are shaped to match the cross-sectional profile of the pile. It is therefore to be understood that the invention is to be construed as limited solely by the scope of the appended claims.

I claim:

1. A method of preparing an end of a pile comprising a concrete matrix and elongate reinforcement therein, said method comprising:

providing a plurality of blades, oriented transversely of the pile at a selected position along the pile;

transversely breaking the concrete matrix at the selected position by driving the plurality of blades into the surface of the concrete matrix around the periphery of the pile, without engaging the reinforcement;

providing a concrete breaker means adjacent the pile and extending between the end of the pile and selected position;

fracturing the concrete matrix between the end of the pile and the selected position along the pile by driving the breaker means into engagement with the concrete matrix; and removing the fractured concrete to expose the reinforcement.

2. A method according to claim 1 comprising simultaneously with driving the blades into the surface, applying tensile stress to the pile at said selected position.

3. A method according to claim 1 wherein providing the plurality of blades comprises providing blades with wedge shaped edges confronting the pile, wherein driving the blades into the matrix wedges the matrix apart at the selected position.

4. A method according to claim 1 comprising simultaneously transversely breaking the concrete matrix and fracturing the matrix between the selected position in the end of the pile.

5. A method according to claim 1 comprising the preliminary step of shearing the pile at a cut off location to provide the pile end.

6. A method according to claim 5 wherein the step of shearing the pile comprises driving a blade laterally through the pile.

7. A method according to claim 6 wherein fracturing the concrete matrix comprises forcing into the surface of the concrete at least one elongate wedge extending from the end of the pile to the selected position.

8. A method according to claim 6 wherein fracturing the concrete matrix comprises forcing into the surface of the concrete matrix a plurality of elongate wedges extending substantially from the selected position to the end of the pile.

9. Apparatus for preparing an end of a pile comprising a concrete matrix and longitudinal reinforcement embedded therein, said apparatus comprising:

pile fracturing means for fracturing the concrete matrix transversely of the pile at a selected location along the pile, said fracturing means comprising:

a plurality of blades having respective cutting edges;

means for mounting the blades around the pile and at a selected position along the pile with the cutting edges confronting the pile; and means for driving the cutting edges of the blades into the surface of the concrete matrix around the periphery of the pile;

concrete breaker means;

means for mounting the breaker means adjacent the pile and between the end of the pile and the selected position; and means for driving the breaker means into engagement with the concrete matrix.

10. Apparatus according to claim 9 including cutoff means comprising a shear blade, and means for driving the shear blade through the pile to sever the pile.

11. Apparatus according to claim 9 wherein the breaker means comprise at least one elongate breaker member fixed to a respective one of the concrete penetrating blades.

12. Apparatus according to claim 9 wherein the breaker means comprise plural breaker members and means for driving the breaker members into opposite sides of the pile.

13. Apparatus according to claim 9 wherein the breaker means comprise plural breaker members fixed to respective ones of the concrete penetrating blades.

14. Apparatus according to claim 10 wherein the shear blade comprises a plate with one edge thereof defining the cutting edge and a bevel on opposite sides of the plate along the cutting edge.

15. Apparatus according to claim 9 wherein each concrete penetrating blade comprises a plate with a leading edge thereof defining the cutting edge and a bevel on one surface of the plate along the cutting edge of the plate.

16. Apparatus according to claim 15 wherein the breaker means comprise at least one elongate wedge with an elongate leading edge, means mounting the wedge on one of the concrete penetrating blades with the leading edge positioned above the bevel.

17. Apparatus according to claim 9, wherein the breaker means comprises an elongate wedge.

18. Apparatus according to claim 8 wherein the breaker means comprises two elongate wedges arranged side by side.

19. Apparatus according to claim 10 where the apparatus comprises a frame with an open centre adapted to receive the pile therethrough, the cutoff means comprising an anvil, means for mounting the anvil on the frame at one side of the open centre end means for mounting the shear blade on the frame for movement across the open centre of the frame towards the anvil.

20. Apparatus according to claim 19 wherein the plurality of blades comprise fixed penetrating blade means, driven penetrating blade means, and including means for mounting the fixed penetrating blade means on the frame at said one side of the open centre, means for mounting the driven penetrating blade means on the frame in place of the shear blade for movement across the open centre of the frame towards the fixed penetrating blade means.

21. Apparatus according to claim 20 wherein the concrete breaker means comprise a breaker member and means mounting the breaker member on the driven penetrating blade means.

22. Apparatus according to claim 20 wherein the concrete breaker means comprise a plurality of elongate breaker members, means mounting the breaker members on the fixed penetrating blade means and the driven penetrating blade means.

23. Apparatus according to claim 9 for cutting a pile having a predetermined cross sectional profile and where the cutting edges of the blades define a collective profile corresponding to the profile of the pile.

24. Apparatus for preparing an end of a pile comprising a concrete matrix and longitudinal reinforcement embedded therein, said apparatus comprising:

a frame with an open centre adapted to receive the pile therethrough;

cutoff means comprising:

an anvil, means for mounting the anvil on the frame at one side of the open centre, a shear blade, means for mounting the shear blade on the frame for movement across the open centre of the frame towards the anvil, and means for driving the shear blade through the pile to sever the pile, breaking means comprising:

a plurality of fracturing blades having respective cutting edges;

means for mounting the blades around the pile and at a selected position along the pile with the cutting edges confronting the pile;

means for driving the cutting edges of the blades into the surface of the concrete matrix around the periphery of the pile;

concrete breaker means;

means for mounting the breaker means adjacent the pile and between the end of the pile and the selected position;

means for driving the breaker means into engagement with the concrete matrix.

* * * * *